US009113697B2

(12) United States Patent
Brensinger et al.

(10) Patent No.: US 9,113,697 B2
(45) Date of Patent: Aug. 25, 2015

(54) ERGONOMIC SEGMENTED PACK

(71) Applicant: Nemo Equipment, Inc., Dover, NH (US)

(72) Inventors: Cam Brensinger, Stratham, NH (US); Suzanne Turell, York, ME (US); Connie Yang, York, ME (US)

(73) Assignee: Nemo Equipment, Inc., Dover, NH (US)

( * ) Notice: Subject to any disclaimer, the term of this patent is extended or adjusted under 35 U.S.C. 154(b) by 112 days.

(21) Appl. No.: 13/854,382

(22) Filed: Apr. 1, 2013

(65) Prior Publication Data

US 2014/0001220 A1 Jan. 2, 2014

Related U.S. Application Data

(63) Continuation-in-part of application No. 12/920,702, filed as application No. PCT/US2008/057682 on Mar. 20, 2008, now abandoned.

(60) Provisional application No. 60/895,771, filed on Mar. 20, 2007.

(51) Int. Cl.

| | |
|---|---|
| ***A45F 3/04*** | (2006.01) |
| ***A45F 3/08*** | (2006.01) |
| *A45F 3/14* | (2006.01) |

(52) U.S. Cl.

CPC ... *A45F 3/04* (2013.01); *A45F 3/08* (2013.01); *A45F 2003/045* (2013.01); *A45F 2003/146* (2013.01)

(58) Field of Classification Search

CPC ..... A45F 2003/045; A45F 2003/144; A45F 2003/146

USPC ..... 224/600–659

See application file for complete search history.

(56) References Cited

U.S. PATENT DOCUMENTS

| | | | | |
|---|---|---|---|---|
| 4,876,829 | A | 10/1989 | Mattick | |
| 5,090,604 | A * | 2/1992 | Howe | 224/641 |
| 5,284,279 | A * | 2/1994 | Sason et al. | 224/632 |
| 5,884,646 | A | 3/1999 | Ju | |
| 5,954,250 | A * | 9/1999 | Hall et al. | 224/262 |
| 6,290,111 | B1 * | 9/2001 | Hedenberg et al. | 224/262 |
| 7,152,771 | B2 * | 12/2006 | Le Gal et al. | 224/631 |
| 7,210,605 | B2 * | 5/2007 | Willows et al. | 224/637 |

(Continued)

OTHER PUBLICATIONS

International Search Report for PCT/US08/057682, US PTO, Jun. 4, 2009.

(Continued)

*Primary Examiner* — Justin Larson
*Assistant Examiner* — Scott McNurlen

(57) ABSTRACT

An anatomically segmented backpack has an upper back region, a lower back region, and a hip belt region. The upper back region includes a shoulder strap joined to a pack load carrying portion and a thorax harness. The thorax harness extends in two opposite directions under each shoulder blade of the user. The lower back region is coupled to the upper back region and a hip region. A slide mechanism is located in the pack load carrying portion of the upper and lower back region. A load-bearing element is disposed within the lower back region, for transferring a load from the upper back region to the user's hips. The hip region is joined to a front section of the pack by a load bearing hip belt that extends around the user.

1 Claim, 7 Drawing Sheets

(56) References Cited

U.S. PATENT DOCUMENTS

| | | | | |
|---|---|---|---|---|
| 8,714,424 | B2 * | 5/2014 | Oddou et al. | 224/262 |
| 2002/0043544 | A1 * | 4/2002 | Caneba | 224/584 |
| 2002/0083653 | A1 | 7/2002 | Hilbert | |
| 2007/0152007 | A1 * | 7/2007 | Kauss et al. | 224/637 |
| 2009/0057360 | A1 * | 3/2009 | Demsky | 224/262 |
| 2011/0305505 | A1 * | 12/2011 | Brensinger et al. | 403/174 |

OTHER PUBLICATIONS

Written Opinion of International Searching Authority for PCT/US08/057682, US PTO May 21, 2009.

* cited by examiner

ERGONOMIC SEGMENTED PACK

CROSS-REFERENCE TO RELATED APPLICATIONS

This application is a Continuation-In-part of U.S. patent application Ser. No. 12/920,702 titled "Outdoor Equipment" filed on Sep. 2, 2010 and claims priority from PCT Application PCT/US2008/057682 titled "Outdoor Equipment" filed on Mar. 20, 2008 and U.S. Provisional Application Ser. No. 60/895,771 titled "Outdoor Equipment" which was filed on Mar. 20, 2007, all of which are incorporated fully herein by reference.

TECHNICAL FIELD

The present invention relates to load carrying mechanisms and more particularly, relates to an anatomically segmented pack separated into upper back, lower back, and hip regions to account for the differing degrees of articulation and the support required by each section.

BACKGROUND INFORMATION

Load carrying packs are generally used in such activities as running, hiking, cycling, climbing, skiing, and snowboarding which all involve moving and twisting of the body in a variety of ways. However, the current pack designs do not accommodate the varying degrees of bending and movement at distinct areas on the user's back region. In particular, the majority of articulation will typically occur in the lower back region of the spine whereas bending in the upper back region is generally more limited. The pack loads are more efficiently carried as close to the body as possible and at the center of mass in order for loads to be transferred from the shoulders and back, to portions of the hips.

While there may be some existing pack designs that provide a mechanism for distributing loads to the hip/waist region, the prior art is lacking in that there are no known packs that allow for different amounts of articulation in a pack along the spinal column.

SUMMARY

The present invention is an anatomically segmented backpack that includes an upper back portion, a lower back portion, and a hip belt portion. The upper back portion has a Y-shaped shoulder strap that has a front and back end and is configured for extending over the shoulders of a user. The shoulder strap is further joined near the back end to a pack load carrying portion and a harness on the lower back. The harness is configured to extend in two opposite directions under each shoulder blade of the user. This harness is joined to the front end of the Y-shaped shoulder strap near the frontal area of the user when the pack is disposed on the user.

The lower back portion has two ends where the first end is located at an opposite side from the second end. The lower back section is joined near the first end to the upper back portion. This lower back portion has a load-bearing element flexibly attached to the upper back portion for transferring a load from the upper back portion to the user's hips.

The hip belt portion is joined to the second end of the lower back portion. There is a coupling device on the hip belt portion that joins the hip belt near and around the frontal region of the user. The hip belt is also configured for supporting a weight disposed in the pack-load carrying portion.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1:
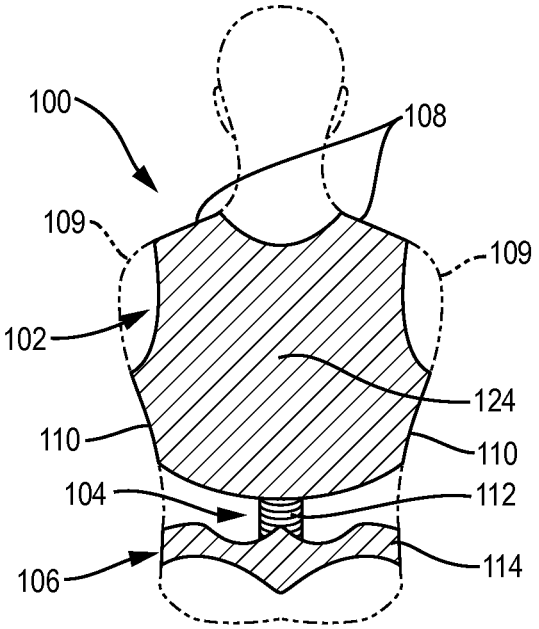
FIG. 1 is a back view of the regions and functions of the segmented pack layout.
Figure 2:
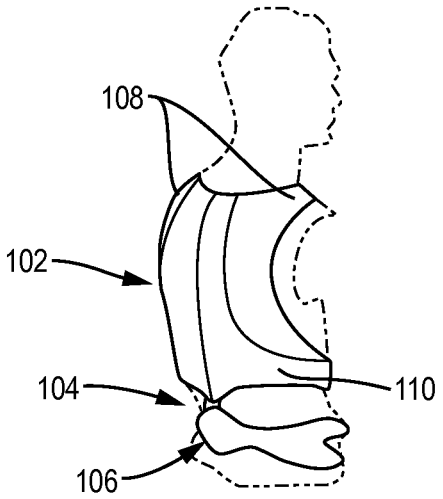
FIG. 2 is a side view of an alternative embodiment of the segmented pack layout.

The present invention is an anatomically segmented pack 100, which is comprised of an upper back region 102, a lower back region 104, and a hip region 106 as shown in FIG. 1 and FIG. 2. The anatomically segmented pack 100 accounts for differing degrees of articulation, support and movement required by each section of the human spine and body. This arrangement and segmentation allows for each respective part of the pack to move unconstrained with the body. The invention's anatomically articulated layout also helps pull the pack's load closer to the upper body in order to more efficiently carry the load, while the load or weight of the pack is transferred from the shoulders and back of a user to the hips using a load bearing element 120 shown in FIG. 6. A pack's load may be discretely compartmentalized by region in order to further enable the greatest amount of articulation at the lower back region 104 and more rigid support in the upper back region 102.

A first embodiment of the anatomically segmented pack 100 according to the present invention is shown in FIG. 1, and includes a pair of integrated shoulder straps 108 (108*a*, 108*b*), a thorax harness 110, an articulated lower back support 112, and a load bearing hip belt 114. The pair of integrated shoulder straps 108 cross over the top of each shoulder 109 and join into a one-piece "Y-shaped" construction proximal to the centerline of the shoulder blades as shown in FIG. 1. The pair of integrated shoulder straps 108 are preferably angled along the back to provide clearance for shoulder blade movement. In the center of the back, including the upper back region and lower back region is the pack load carrying portion 124. This clearance may be facilitated by a lacing or tightening system to further draw in the pair of integrated shoulder straps 108 to the center of the back. Alternatively, the material of the straps may feature a stretch or flexibility in order to facilitate drawing of the straps toward the body.

Figure 5:
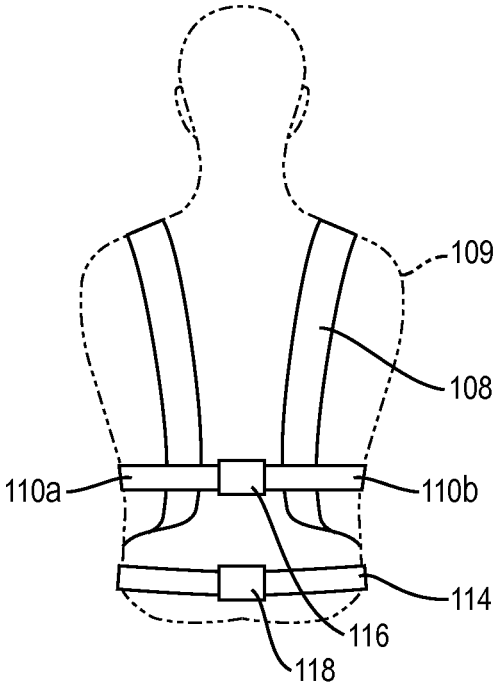
FIG. 5 is a detailed front view of an embodiment of the present invention with the clasp details.

The thorax harness 110 of the anatomically segmented pack 100 is located in the lower back region 104 where the thorax harness 110 extends from the bottom of the pair of integrated shoulder straps 108 in two opposite directions under each respective shoulder blade 109, and continues around to the front of the body as shown in FIG. 5. The thorax harness 110 is coupled to the pair of integrated shoulder straps 108 on both the back and the front side of the user. The two portions (110*a*, 110*b*) of the thorax harness 110 connect to one another with a thorax harness clasp 116. The thorax harness clasp 116 can be a snap-lock buckle or any other suitable attachment mechanism. The thorax harness 110 is effectively fixed to the ribcage of the user in order to hold the upper portion of the pack to the body. When the pair of integrated shoulder straps 108 are pulled tight, the load is transferred in a vertical direction in reference to the back, pulling the pack inwards and closer to the body. The pair of integrated shoulder straps 108 are pulled tight using a clip or loop that holds and adjusts the straps, and allows for tightening and loosening of the straps, as is well known in the art.

Figure 6:
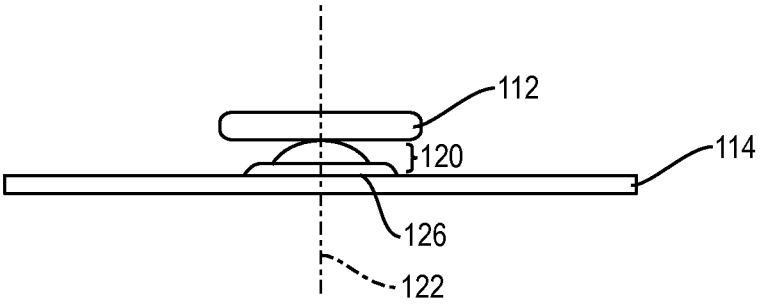
FIG. 6 is a detailed view of the load bearing element of the present invention.

The lower back region 104 of the pack 100 is flexibly attached to the upper back region 102 of the pack by means of a load bearing element 120 such as a cylindrical piston, FIG. 6. The load bearing element 120 carries the bulk of the load. The ability of the load bearing element 120 to expand and contract, rotate and twist serves to transfer or buffer any upward and downward or twisting movement of the load created during relative rotations of the shoulder and back of the user, to the load bearing hip belt 114. All of the articulation occurs in the load bearing element 120 while at the same time the load bearing element 120 allows for full body articulation by the user. The lower back region 104 therefore allows for a full range of spinal movement while distributing the weight to the hips using the anatomically shaped load bearing hip belt 114 that bears the load of the pack. Each end of the load bearing hip belt 114 is adjustably fastened at the user's front with a load bearing hip belt clasp 118. The load bearing hip belt clasp 118 can be a snap-lock buckle or any other suitable attachment mechanism.

Figure 7A:
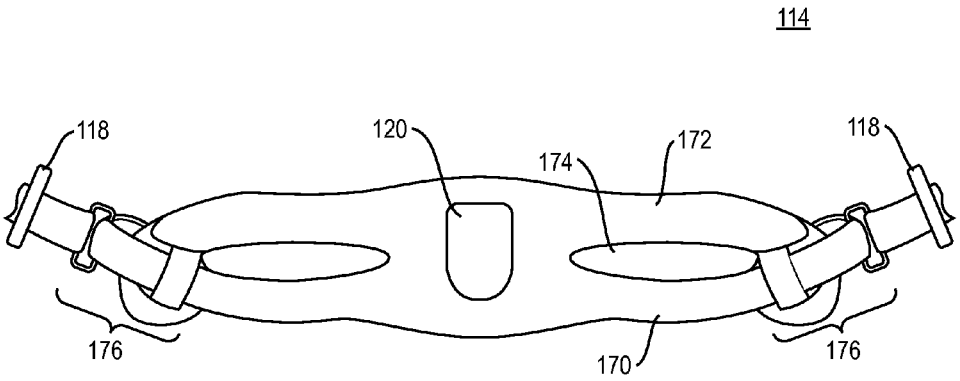
FIG. 7*a* is a detailed view of a first side of the load bearing hip belt.
Figure 7B:
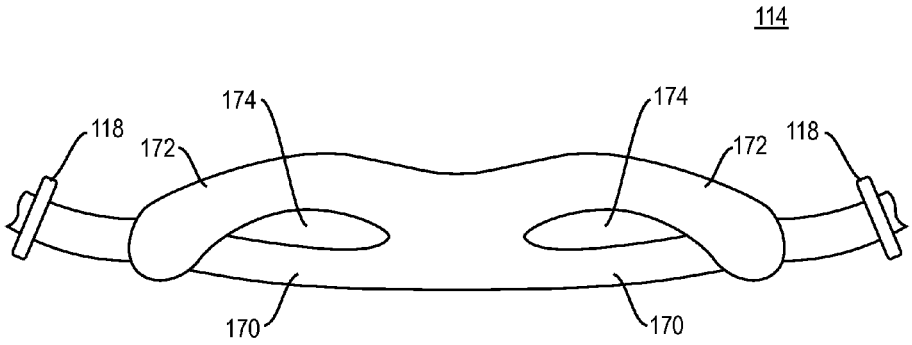
FIG. 7*b* is a detailed view of a second side of the load bearing hip belt.
Figure 7C:
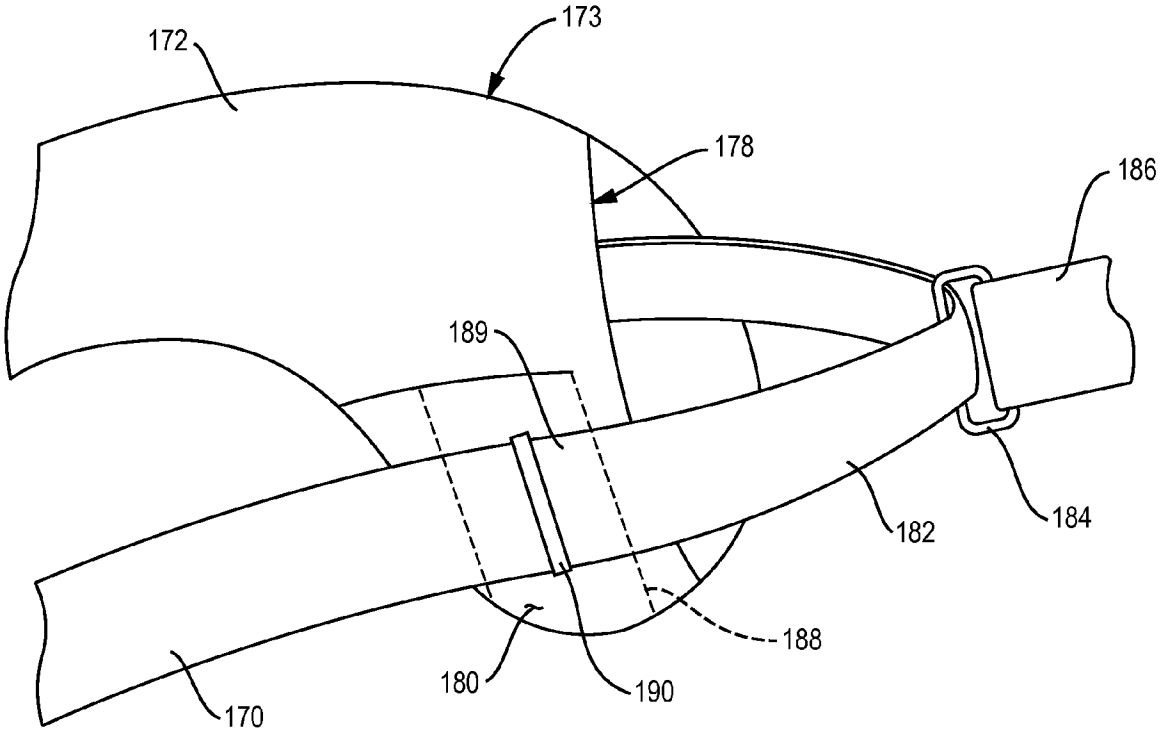
FIG. 7*c* is a detailed view of the adjustment region of the load bearing hip belt.

The load bearing hip belt 114 may also be fully customizable to a user. As shown in FIGS. 7*a*, 7*b* and 7*c*, the load bearing hip belt 114 may be a two part design, with an upper hip belt portion 172 and a lower hip belt portion 170. The split design creates two open regions 174. The upper hip belt portion 172 and lower hip belt portion 170 connect with one another in the adjustment regions 176.

The upper hip belt portion 172 (FIG. 7*c*) is in contact on an inner surface 173 with the user and on the outer surface features a pocket 178. A band of material 188 overlaps the pocket 178, thereby creating a pass through section 180. The lower hip belt portion 170 passes at least partially into the pass through section 180 and connects to a first end 189 of an adjustable strap 182 at a connection point 190. In use, the connection point 190 moves freely back and forth through the pass through section 180 in reaction to adjustments to the strap made by the user. The adjustable strap 182 then passes through a loop 184 and returns back into the pocket 178, where the adjustable strap 182 is secured to an interior portion of the pocket 178 (not shown).

The adjustable strap 182 can be used to customize the fit around the waist of a user. The adjustable strap passes through the loop 184 and freely moves in both directions to accommodate various positions of the adjustable strap 182. In this way, the loop 184 functions as a pulley. The loop 184 is also attached to a belt strap 186 which contains the load bearing hip belt clasp 118, which connects to the hip belt clasp 118 at the opposite end in order to secure the load bearing hip belt 114 around the waist of a user. In use, the load bearing hip belt 114 is secured around the waist using the load bearing hip belt clasp 118 and then the user is able to customize the fit of the load bearing hip belt 114 to their waist using the adjustable strap 182 to move the upper and/or lower belt portions 170/172 into a comfortable position. The fully customizable load bearing hip belt 114 enables users of different sizes and shapes to share packs comfortably, for users to adjust the load bearing hip belt 114 when they add or remove additional layers of clothing, and provide a customized fit without the need for actual customization of the load bearing hip belt 114.

The load bearing hip belt clasp 118 can be tightened or loosened as needed, as is well known in the art. Additionally, the upper and lower belt portions 170/172 may feature a plurality of padding sections on one or more sides in order to provide additional cushioning. The plurality of padding sections may feature gaps in-between each padding section in order to facilitate a natural curve in the load bearing hip belt 114.

In one embodiment of the present invention, as shown in FIG. 2, the integrated shoulder straps 108 also extend over the top of each shoulder but immediately connect to form a broad one-piece construction that extends over the entire upper and lower back region of the user including the shoulder blades. The upper back region 102 has a thorax harness 110 that again extends under each arm and wraps around the ribcage. The ends of the thorax harness straps are fastened to the respective lower ends of each integrated shoulder strap 108 where the harness straps can be pulled tight to draw the pack load closer to the body. The harness straps are pulled tight using a clip or loop that holds and adjusts the straps, and allows for tightening and loosening of the straps, as is well known in the art. Other adjustment mechanisms are contemplated and within the scope of the current invention. The thorax harness 110 connects to the shoulder strap 108 at a lower part of the shoulder strap 108 as shown in FIG. 5. A load bearing element 120, such as a cylindrical piston works similarly in this embodiment in order to carry the load to the hips.

The load bearing element 120 as shown in FIG. 6 is located in the hip region 106 of the pack 100. The load bearing element 120 features a rotation or rotary motion that provides increased flexibility and movement in the hip region 106 of the pack 100. The load bearing element 120 can feature various designs, such as a ball and socket (shown generally in FIG. 6 as 120*a* and 120*b*), a ball joint, a pivot joint, a rotary piston, a cylindrical piston, or another similar design. The load bearing element 120 allows for at least two directional motions and can also provide for motion in more than two directions. The load bearing element 120 operates around a central axis 122. The design of the load bearing element 120 is such that when a wearer of the pack moves in a lateral flexion direction to the left or right the pack will have the ability to rotate and flex as if part of the body of the wearer of the pack.

The load bearing element 120 is fixably attached on one side to the load bearing hip belt 114 at an attachment area 126. The opposite side of the load bearing element 120 also makes contact with the articulated lower back support 112. In a preferred embodiment of the present invention, the articulated lower back support 112 is padded such that the articulated lower back support 112 provides a cushion between the back of the user and the load bearing element 120.

Figure 8A:
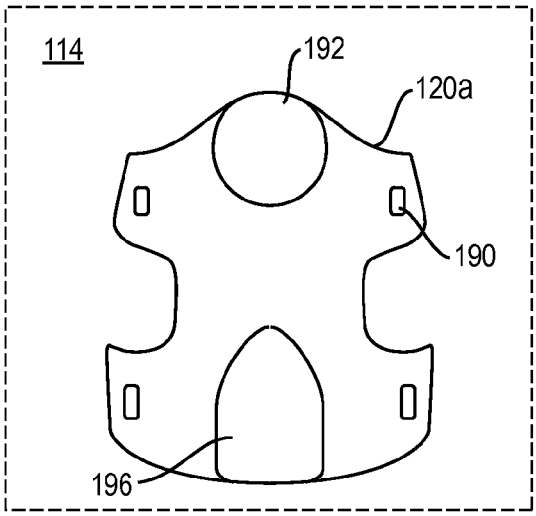
FIG. 8*a* is a detailed view of a first component of the load bearing element.
Figure 8B:
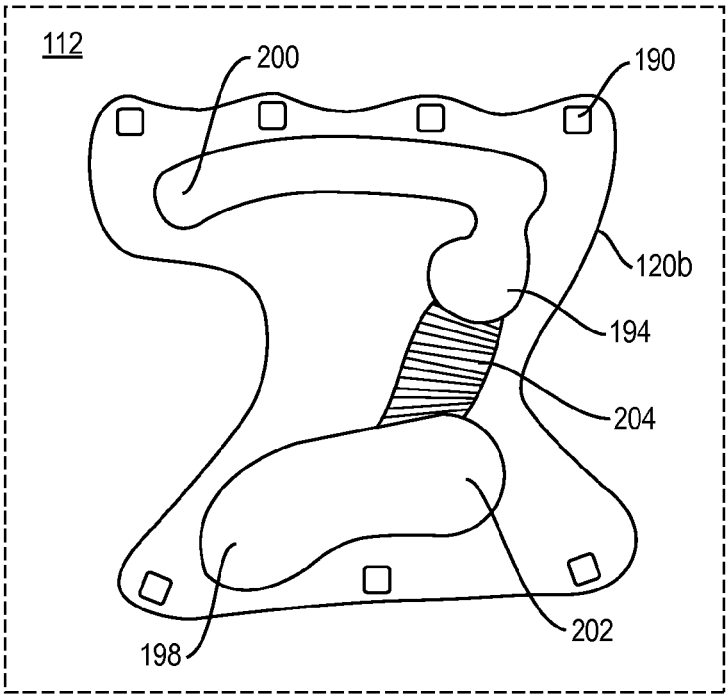
FIG. 8*b* is a detailed view of a second component of the load bearing element.

A preferred design of the load bearing element 120 features a first component 120*a* located on the load bearing hip belt 114, FIG. 8*a*, and a second component 120*b* located on the articulated lower back support 112, FIG. 8*b*. In this embodiment, the first component 120*a* includes one or more attachment devices 190 to secure the first component 120*a* to the load bearing hip belt 114. Similarly, the second component 120*b* also features one or more attachment devices 190 to secure the second component 120*b* to the articulated lower back support 112. In a preferred embodiment, the second component 120*b* is secured through the articulated back support 112 and connected with the internal frame (not shown). In the design shown, the first component 120*a* includes a rounded protrusion 192 which is configured to enter a rounded opening 194 of the second component 120*b*. The first component 120*a* also includes an oval shaped protrusion 196 which is configured to enter a lower portion of a kidney or oval shaped opening 198 on the second component 120*b*.

In use, the first component 120*a* is placed at and angle and the round protrusion 192 is aligned with the round opening 194 and the oval protrusion 196 is aligned with the lower portion of a kidney or oval shaped opening 198. The oval and round protrusions 192/196 then simultaneously enter the openings 194/198 on the second component 120*b* and the first component 120*a* is rotated such that the round protrusion 192 moves to a first fitted position 200 and the oval protrusion 196 moves to a second fitted position 202. Once in the fitted positions 200/202, the user secures the belt using the load bearing hip belt clasp 118 around their waist. When the load bearing hip belt 114 is secured around a user's waist, the two components cannot be separated. The first and second components 120*a*/120*b* are preferably made from a smooth composite material which allows for easy attachment of the two components to one another. The second component 120*b* also may feature an indented area 204 that enables the two components to freely slide even when sand, dirt or other debris is present. The design as shown in FIGS. 8*a* and 8*b* is merely one embodiment of the present invention and it is contemplated and within the scope of the present invention that the two components could have many similar designs and shapes in order to accomplish a similar connection.

Figure 3:
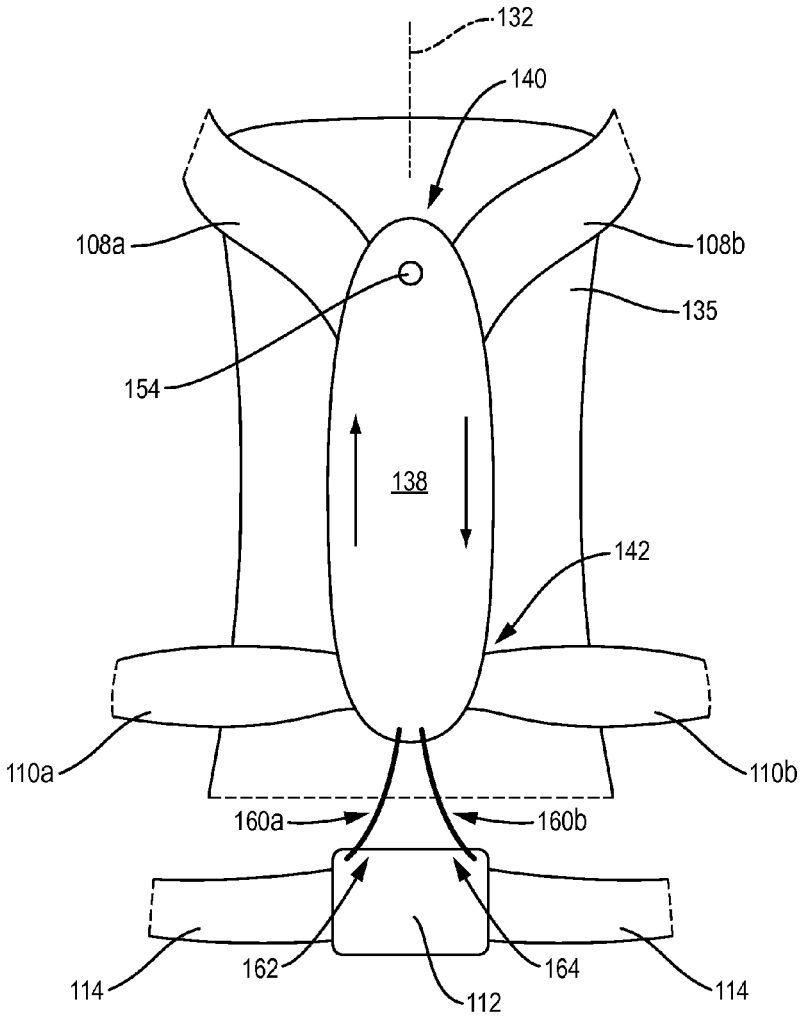
FIG. 3 is a detailed view of one embodiment of the load bearing element and slide mechanism of the present invention.
Figure 4:
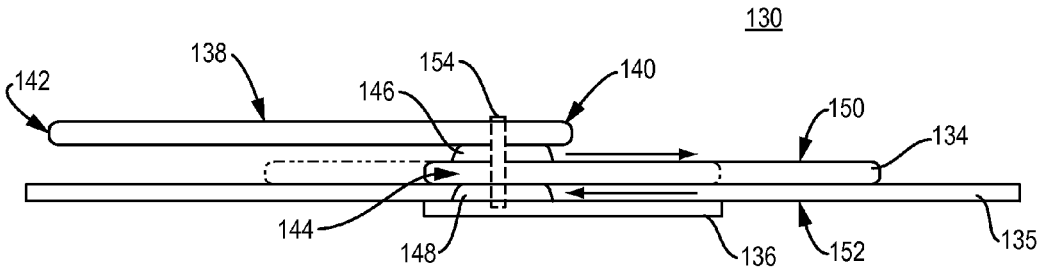
FIG. 4 is a detailed view of the slide mechanism of the present invention.

In another embodiment of the present invention the anatomically segmented pack 100, features a slide mechanism 130 in the upper back region 102 as shown in FIGS. 3 and 4. The slide mechanism allows the pack to move with the user of the pack when the user bends forward. The slide mechanism 130 is located along a centerline 132. The slide mechanism 130 is comprised of a fixed portion 134 that is secured to the upper back region 102 of the pack 100. The fixed portion 134 is fixably secured to the pack 100 and is preferably secured through a material 135 of the fixed portion 134 and to an interior frame portion (not shown). The attachment of the fixed portion through the material and to an interior frame ensures the fixed portion cannot detach or rip away from the material of the pack 100. The fixed portion 134 is preferably secured to the interior frame portion with a plurality of attachment devices, such as bolts, which are not easily removed. The fixed portion 134 includes an opening 136 that runs along the centerline 132. The slide mechanism 130 also includes a movable portion 138. The movable portion 138 is attached at an upper end 140 to the integrated shoulder strap 108. The movable portion 138 is attached at a lower end 142 to the thorax harness 110.

The movable portion 138 further features an attachment mechanism 144. The attachment mechanism 144 secures the movable portion 138 to the fixed portion 134 and allows the movable portion 138 to slide up and down along the opening 136. The attachment mechanism 144 may be a multi-part washer that includes a first portion 146 and a second portion 148, wherein the first portion 146 is attached to the movable portion 138 and located on a first side 150 of the fixed portion 134 and the second portion 148 is attached to the first portion 146 and located on a second side 152 of the fixed portion 134. The first portion 146 and second portion 148 are held in place with a mounting piece 154. The mounting piece 154 can be a bolt, a pin, or any similar device. Other attachment mechanisms 144 are considered to be within the scope of the invention.

When a user is in a fully upright position the attachment mechanism 144 will be located at the bottom of the opening 136 located on the fixed portion 134. As a user bends in a forward direction, the attachment mechanism 144 will slide upward in the opening 136 to match the forward bend by the user. The slide mechanism 130 allows the weight of the pack 100 to be transferred seamlessly when the user leans forward and then returns to an upright position, allowing for greater control of the pack 100 during movement and less effort to be employed by the user.

The lower end 142 of the movable portion 138 may further feature a flexible connection mechanism 160. The flexible connection mechanism 160 is fixably attached to the lower end 142 of the movable portion 138 and also fixably attached to the hip region 106. In an exemplary embodiment of the present invention, the attachment of the flexible connection mechanism 160 in the hip region 106 occurs on the articulated lower back support 112. The flexible connection mechanism 160 features an elastic function, which allows the movable portion 138 to move up and down based upon the tension in the flexible connection mechanism 160. In an exemplary embodiment of the invention, there are at least two flexible connection mechanisms 160*a*/160*b*, wherein both flexible connection mechanisms 160*a*/160*b* connect to a lower end 142 of the movable portion 138 and wherein a first flexible connection mechanism 160*a* attaches to a first upper portion 162 of the articulated lower back support 112 and a second flexible connection mechanism 160*b* attaches to a second upper portion 164 of the articulated lower back support 112. Each of the flexible connection mechanisms 160*a*/160*b* may be a single connection element or a series of multiple connection elements. The flexible connection mechanism 160 preferably includes an elastomer, and may be made from rubber, latex, nylon, polyester, cotton, or another similar material.

The slide mechanism 130 works in conjunction with the load bearing element 120 to provide seamless movement of the pack in concert with the motions that are employed by the wearer of the pack. The slide mechanism 130 and load bearing element 120 allow a user to bend forward and side to side naturally. The pack 100 stays relatively in place on the back of the user without major shifts in weight occurring when the user moves. The design reduces fatigue in the user and allows the user to carry a larger load for a longer period of time.

Figure 9C:
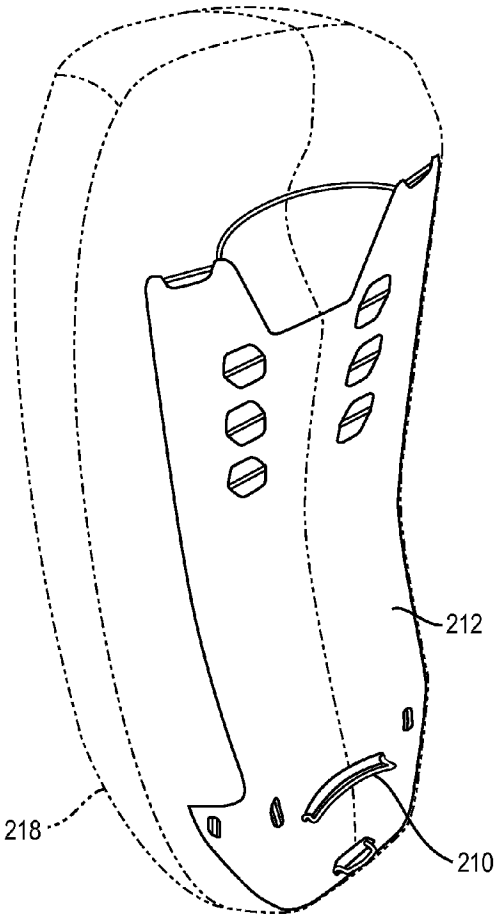
FIG. 9*c* is a detailed view of the fabric material over the wire frame.
Figure 9B:
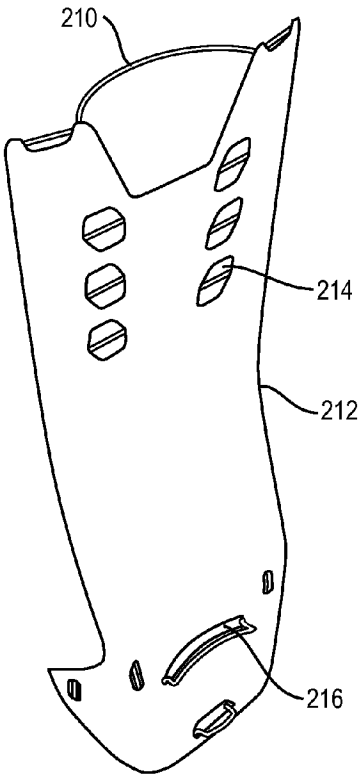
FIG. 9*b* is a detailed view of the molded frame over the wire frame.
Figure 9A:
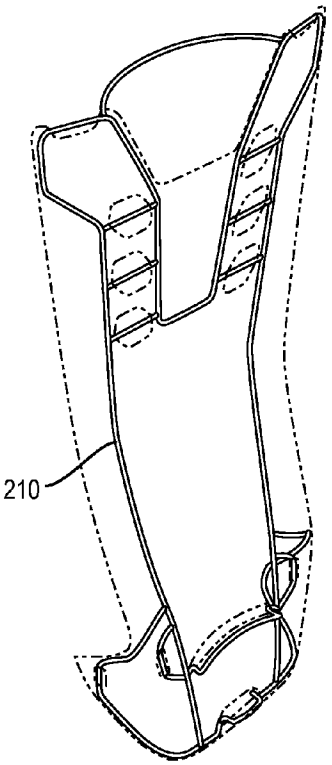
FIG. 9*a* is a detailed view of the wire frame.

In a preferred embodiment of the present invention, many of the previously described components are attached not to the fabric or pack material, but rather make direct connection with the internal frame, FIGS. 9*a*, 9*b* and 9*c*. In this way, the various components are rigidly secured and are not prone to ripping or pealing away from the fabric or pack material. FIG. 9*a* details one embodiment of a wire frame 210. The wire frame 210 may be an aluminum rod or another similar material. FIG. 9*b* details the wire frame with a molded pack frame 212 which is placed over the wire frame 210. The molded pack frame may be an ABS plastic material or another similar material. One or more upper openings 214 in the molded pack frame 212 are provided to allow attachment of the shoulder straps 108 directly to the wire frame 210. One or more lower openings 216 may also be provided to allow direct connection of other parts of the backpack, such as the load bearing element 120. FIG. 9*c* details the outer pack material 218 shown over the molded pack frame 212, with the wire frame 210 still exposed at the upper and lower openings 214/216.

Accordingly, the present invention provides a novel, anatomically segmented back-pack which provides for better load carrying capabilities based on its segmented and anatomical design.

Modifications and substitutions by one of ordinary skill in the art are considered to be within the scope of the present invention, which is not to be limited except by the following claims.

The invention claimed is:

1. A load bearing hip belt, configured for interconnecting with a load by means of a load bearing element, said load bearing hip belt comprising:

a hip belt comprising a central region and first and second hip belt end portions coupled to first and second opposite sides of said central portion respectively;

said central region including the load bearing element, configured for interconnecting with the load;

each of said first and second hip belt end portions including an upper hip belt portion and a lower hip belt portion;

wherein said upper hip belt end portion and said lower hip belt end portion slidably interconnect with one another in an adjustment region, wherein a first end of each of said first and second lower hip belt end portions are fixed to an end region of said first and second upper hip belt end portions respectively;

each of said first and second upper hip belt end portions including a band of material fixed proximate first and second ends to respective said first and second upper hip belt end portions and forming a pass through section for said respective first and second lower hip belt end portions in said adjustment region, said band of material configured for allowing said upper and lower hip belt end portions to slide freely back and forth vis-à-vis one another and independent of one another to accommodate a customized fit for a user of said load bearing hip belt; and first and second loop elements, a first side of each of said first and second loop elements coupled to one of said first and second lower hip belt end portions between said first end of each of said first and second lower hip belt end portions and said band of material, a second side of each of said first and second loop elements coupled to first and second hip belt straps, each of said first and second hip belt straps including at a distal end portion thereof a coupling device for coupling said first and second hip belt straps together proximate and around a front region of a user.

* * * * *